US007779912B2

(12) United States Patent
Gissler

(10) Patent No.: US 7,779,912 B2
(45) **Date of Patent: *Aug. 24, 2010**

(54) WELL TOOL HAVING MAGNETICALLY COUPLED POSITION SENSOR

(75) Inventor: Robert W. Gissler, Spring, TX (US)

(73) Assignee: Welldynamics, Inc., Spring, TX (US)

( * ) Notice: Subject to any disclaimer, the term of this patent is extended or adjusted under 35 U.S.C. 154(b) by 50 days.

This patent is subject to a terminal disclaimer.

(21) Appl. No.: 11/679,793

(22) Filed: Feb. 27, 2007

(65) Prior Publication Data

US 2007/0170915 A1 Jul. 26, 2007

Related U.S. Application Data

(63) Continuation-in-part of application No. 11/624,282, filed on Jan. 18, 2007, now Pat. No. 7,673,683.

(51) Int. Cl.
*E21B 47/09* (2006.01)
*E21B 31/06* (2006.01)

(52) U.S. Cl. ..... 166/255.1; 166/66.5; 166/250.01

(58) Field of Classification Search ..... 166/250.01, 166/255.1, 66.5
See application file for complete search history.

(56) References Cited

U.S. PATENT DOCUMENTS 2,558,427 A 6/1951 Fagan
3,105,551 A 10/1963 Ehlert
3,222,591 A 12/1965 Mynall
5,030,490 A 7/1991 Bronowicki et al.
5,965,964 A 10/1999 Skinner et al.
6,062,315 A 5/2000 Reinhardt
6,095,248 A 8/2000 Freeman
6,343,649 B1 2/2002 Beck et al.
6,411,084 B1 6/2002 Yoo
6,446,717 B1 9/2002 White et al.
6,484,800 B2 11/2002 Carmody et al.
2004/0261688 A1 12/2004 MacGregor et al.
2007/0170914 A1 7/2007 Gissler
2007/0170915 A1 7/2007 Gissler

OTHER PUBLICATIONS

International Search Report for PCT/US06/02118 dated Oct. 23, 2006.
International Search Report and Written Opinion issued for International Patent Application No. PCT/US07/79945 dated Jan. 28, 2008 (10 pages).

(Continued)

*Primary Examiner*—David J Bagnell
*Assistant Examiner*—Brad Harcourt
(74) *Attorney, Agent, or Firm*—Marlin R. Smith

(57) ABSTRACT

A well tool having a magnetically coupled position sensor. In operation of a well tool, relative displacement is produced between members of the well tool. A magnetically coupled position sensor includes one magnet assembly attached to a member for displacement therewith and another magnet assembly movably attached to the other member and magnetically coupled to the first magnet assembly for displacement therewith. The position sensor further includes a magnetically permeable material which increases a magnetic flux density between the magnet assemblies. The magnetically permeable material may be positioned between magnets of the magnet assemblies and/or spaced apart therefrom.

20 Claims, 12 Drawing Sheets

OTHER PUBLICATIONS

International Preliminary Report on Patentability and Written Opinion for International Patent Application No. PCT/US2006/002118 dated Jul. 29, 2008.

Search Report for International Patent Application No. PCT/US06/08375 dated Nov. 14, 2006.

International Search Report and Written Opinion issued for International Application No. PCT/US07/78872 filed Sep. 19, 2007 (9 pages).

Examiner's first report issued Jan. 27, 2010, for Australian Patent Application Serial No. 2006336317, 2 pages.

WELL TOOL HAVING MAGNETICALLY COUPLED POSITION SENSOR

CROSS-REFERENCE TO RELATED APPLICATIONS

The present application claims the benefit under 35 USC §119 of the filing date of International Application No. PCT/US2006/008375 filed 9 Mar. 2006, and is a continuation-in-part of U.S. patent application Ser. No. 11/624,282 filed 18 Jan. 2007 now U.S. Pat. No. 7,673,683 which claims the benefit under 35 USC §119 of the filing date of International Application No. PCT/US2006/002118 filed 23 Jan. 2006. The entire disclosures of these prior applications are incorporated herein by this reference.

BACKGROUND

The present invention relates generally to equipment utilized and operations performed in conjunction with a subterranean well and, in an embodiment described herein, more particularly provides a well tool having a magnetically coupled position sensor.

In some types of well tools, it is beneficial to be able to determine precisely the configuration of the tool at given points in time. For example, a downhole choke has a closure assembly which is opened or closed by varying amounts to produce a corresponding increase or decrease in flow through the choke. To obtain a desired flow rate through the choke, it is important to be able to determine the position of the closure assembly.

Therefore, it will be appreciated that improvements in position sensors are desirable for use with well tools. As with other instrumentation, sensors and other equipment used in well tools, factors such as space, reliability, ability to withstand a hostile environment, cost and efficiency are important in improved position sensors for use with well tools.

SUMMARY

In carrying out the principles of the present invention, an improved magnetically coupled position sensor is provided. One example is described below in which a magnetically permeable material is used to increase a magnetic flux density between magnets in the position sensor. Another example is described below in which the magnets have aligned pole axes.

In one aspect of the invention, a well tool for use in conjunction with a subterranean well is provided. The well tool includes members, such that relative displacement between the members is produced in operation of the well tool. A magnetically coupled position sensor includes magnet assemblies, with one of the magnet assemblies being attached to one of the members for displacement with the member, and the other magnet assembly being movably attached to the other member and magnetically coupled to the first magnet assembly for displacement with the first magnet assembly.

The position sensor further includes a magnetically permeable material which increases a magnetic flux density between the magnet assemblies. The magnetically permeable material may be positioned between magnets of the first magnet assembly. Alternatively, or in addition, the magnetically permeable material may straddle the magnets of the first magnet assembly.

In another aspect of the invention, the magnetically permeable material may be positioned external to a housing containing the magnets of the first magnet assembly. The magnetically material may also, or alternatively, be positioned internal to the housing or in the second magnet assembly. The magnetically permeable material may be spaced apart (e.g., radially) from the magnets of the first magnet assembly.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
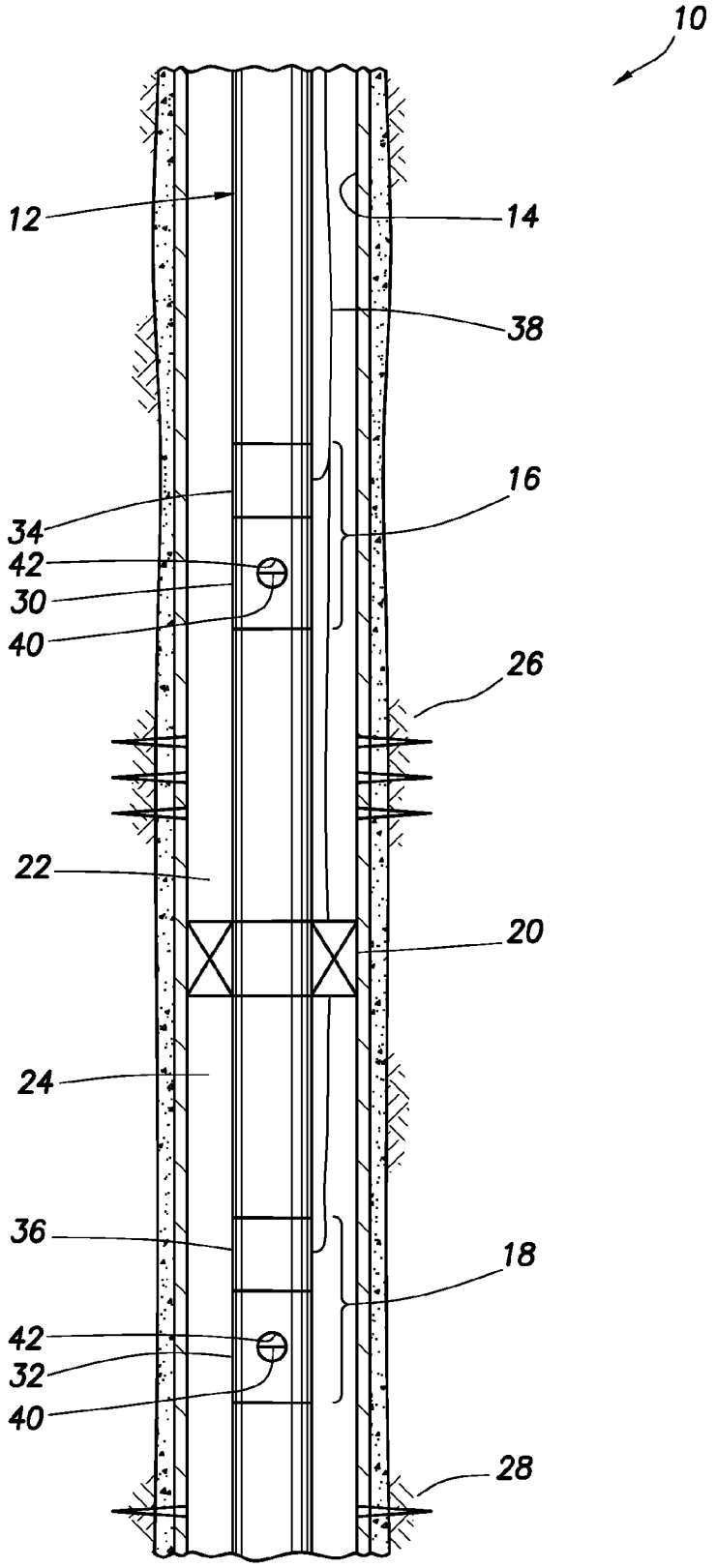
FIG. 1 is a schematic partially cross-sectional view of a well system embodying principles of the present invention.

Representatively illustrated in FIG. 1 is a well system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, a tubular string 12 has been installed in a wellbore 14. Two well tools 16, 18 are interconnected in the tubular string 12 for controlling a rate of production from each of respective zones 26, 28 intersected by the wellbore 14. Note that, instead of production, either of the well tools 16, 18 could be used for controlling a rate of injection into either of the zones 26, 28.

A packer 20 isolates an upper annulus 22 from a lower annulus 24. Thus, the well tool 16 controls the rate of flow between the upper annulus 22 and the interior of the tubular string 12, and the well tool 18 controls the rate of flow between the lower annulus 24 and the interior of the tubular string. For this purpose, the well tool 16 includes a choke 30 and an associated actuator 34, and the well tool 18 includes a choke 32 and an associated actuator 36.

Although the well tools 16, 18 are described as including the respective chokes 30, 32 and actuators 34, 36, it should be clearly understood that the invention is not limited to use with only these types of well tools. For example, the principles of the invention could readily be incorporated into the packer 20 or other types of well tools, such as artificial lift devices, chemical injection devices, multilateral junctions, valves, perforating equipment, any type of actuator (including but not limited to mechanical, electrical, hydraulic, fiber optic and telemetry controlled actuators), etc.

In the system 10 as illustrated in FIG. 1, each of the chokes 30, 32 includes a closure assembly 40 which is displaced by the respective actuator 34, 36 relative to one or more openings 42 to thereby regulate the rate of fluid flow through the openings. One or more lines 38 are connected to each actuator 34, 36 to control operation of the actuators. The lines 38 could be fiber optic, electric, hydraulic, or any other type or combination of lines. Alternatively, the actuators 34, 36 could be controlled using acoustic, pressure pulse, electromagnetic, or any other type or combination of telemetry signals.

Figure 2:
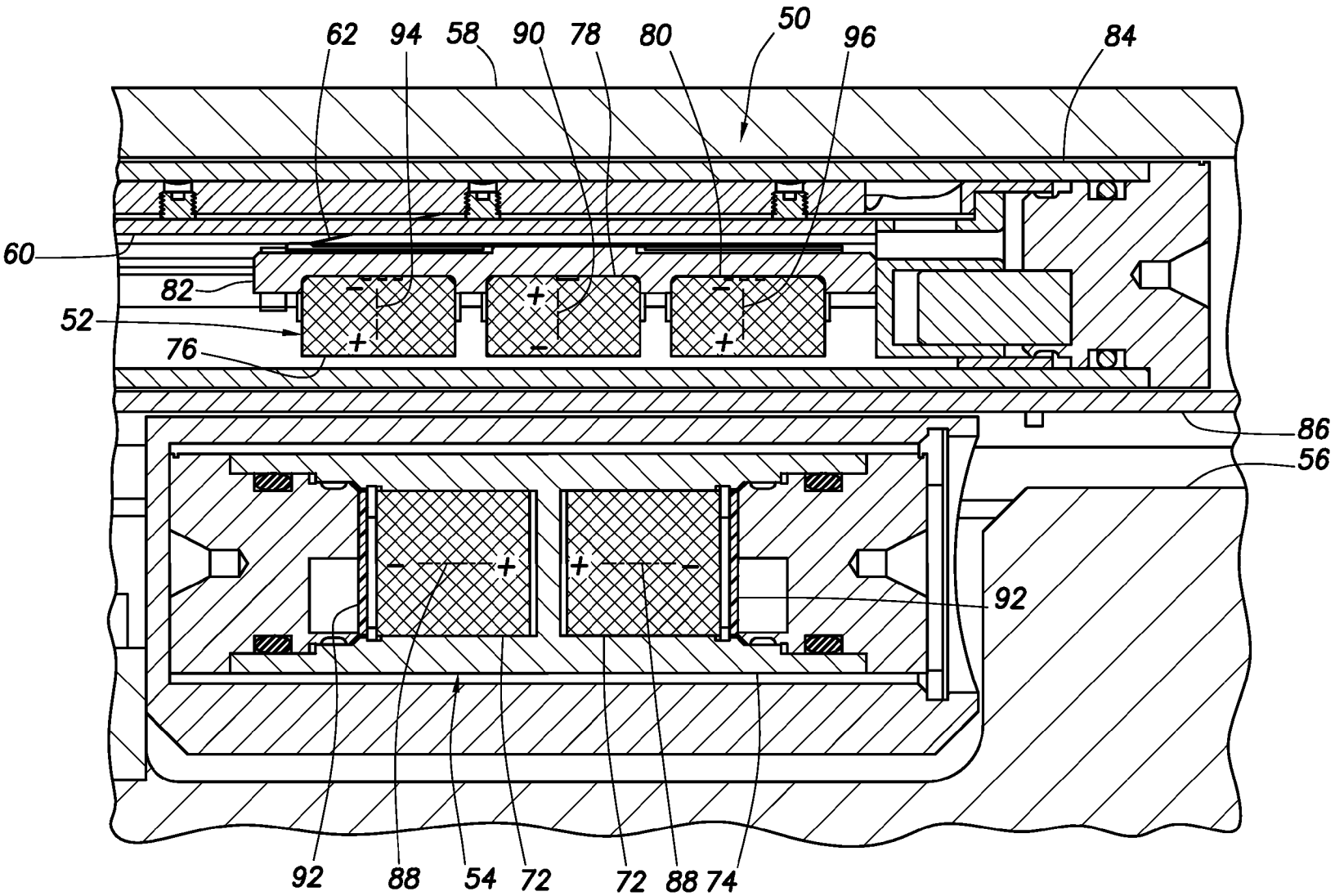
FIG. 2 is an enlarged scale cross-sectional view of a position sensor which may be used in a well tool in the system of FIG. 1.

Referring additionally now to FIG. 2, an enlarged scale cross-sectional view of a magnetically coupled position sensor 50 embodying principles of the invention is representatively illustrated. The position sensor 50 may be used in either or both of the well tools 16, 18 in the system 10 and/or in other types of well tools. For convenience and clarity, the following description will refer only to use of the position sensor 50 in the well tool 16, but it should be understood that the position sensor could be similarly used in the well tool 18.

The position sensor 50 includes two magnet assemblies 52, 54. One of the magnet assemblies 54 is attached to a member 56 which is part of the closure assembly 40. The other magnet assembly 52 is slidably or reciprocably attached to an outer housing member 58 of the actuator 34. The housing member 58 is part of an overall outer housing assembly of the well tool 16.

In operation of the actuator 34, the closure assembly member 56 is displaced relative to the housing member 58 to regulate flow through the opening 42. The position sensor 50 is used to determine the relative positions of the members 56, 58, so that the flow rate through the opening 42 can be determined or adjusted.

The magnet assemblies 52, 54 are magnetically coupled to each other, so that when the closure assembly member 56 displaces relative to the housing member 58, the magnet assembly 52 displaces with the magnet assembly 54 and slides relative to the housing member. A resistive element 60 is rigidly attached relative to the housing member 58. Contacts 62 carried on the magnet assembly 52 electrically contact and slide across the resistive element 60 as the magnet assembly 52 displaces.

Figure 3:
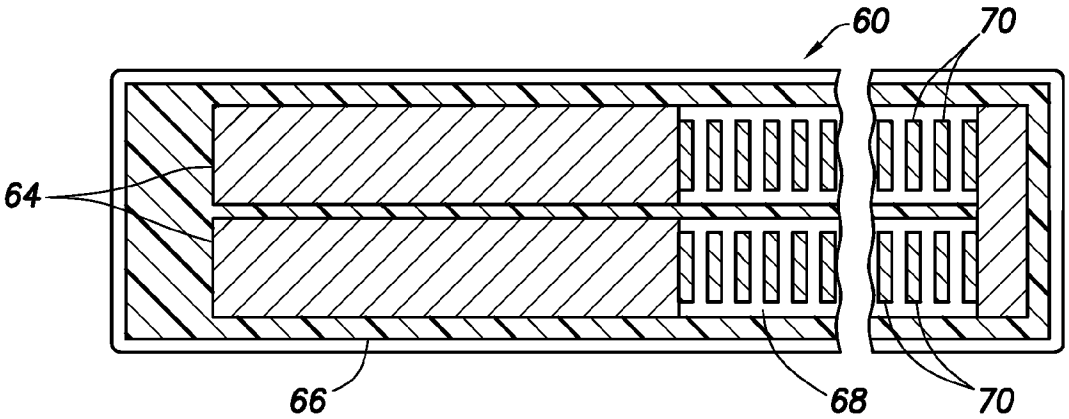
FIG. 3 is an elevational view of a resistive element used in the position sensor of FIG. 2.

A plan view of the resistive element 60 is depicted in FIG. 3. In this view it may be seen that there are two longitudinally extending resistive traces 68 positioned on an insulative layer 66 of the resistive element 60. The contacts 62 make an electrical connection between the traces 68 at different positions along the traces, thereby changing a measured resistance across the resistive element 60, which provides an indication of the position of the magnet assembly 52. Conductive metal strips 64 permit convenient electrical connections (such as by soldering) to the resistive element 60.

Discrete conductive metal pads 70 are applied over the resistive traces 68. In this manner, displacement of the contacts 62 over the pads 70 will provide discrete changes in resistance as detected. Use of the pads 70 reduces jittering in the detected resistance signal as the contacts 62 displace across the pads, thereby providing a relatively constant resistance indication as the contacts 62 traverse each pair of opposing pads.

The magnet assembly 54 as illustrated in FIG. 2 includes two magnets 72 contained within a pressure bearing housing 74. The housing 74 is preferably made of a non-magnetically permeable material (such as inconel, etc.). The housing 74 isolates the magnets 72 from well fluid and debris in the well tool 16.

The magnet assembly 52 includes three magnets 76, 78, 80 mounted on a slider 82. The magnet assembly 52 and resistive element 60 are enclosed within a sealed tubular structure 84. The tubular structure 84 is supported by an inner tubular wall 86, which also protects the tubular structure from debris (such as magnetic particles, etc.) in the well fluid. The tubular structure 84 and inner wall 86 are preferably made of a non-magnetically permeable material, so that they do not interfere with the magnetic coupling between the magnet assemblies 52, 54.

Note that the magnets 72 have like poles facing each other, with pole axes 88 being aligned and collinear with each other. It will be appreciated by those skilled in the art that this configuration produces a high magnetic flux density between the magnets 72 perpendicular to the pole axes 88.

To take advantage of this high magnetic flux density between the magnets 72, the magnet 78 is positioned with its opposite pole facing toward the high magnetic flux density between the magnets 72, and with its pole axis 90 perpendicular to the pole axes 88 of the magnets 72. This serves to increase the magnetic coupling force between the magnets 72 and the magnet 78.

In order to concentrate the magnetic flux density at the opposite ends of the magnets 72, a magnetically permeable material (such as a steel alloy) 92 is positioned at each opposite end and is oriented perpendicular to the pole axes 88. It will be appreciated by those skilled in the art that this configuration produces a high magnetic flux density at the opposite ends of the magnets 72 perpendicular to the pole axes 88.

To take advantage of this high magnetic flux density at the opposite ends of the magnets 72, the magnets 76, 80 are positioned with their opposite poles facing toward the high magnetic flux density at the opposite ends of the magnets 72, and with their respective pole axes 94, 96 perpendicular to the pole axes 88 of the magnets 72. This serves to further increase the magnetic coupling force between the magnets 72 and the magnets 76, 80.

The slider 82 could be made of a magnetically permeable material, in order to decrease a magnetic reluctance between the magnets 76, 78, 80. This would further serve to increase the magnetic flux density and magnetic coupling force between the magnets 76, 78, 80 and the magnets 72.

Although the magnet assembly 54 is depicted with the positive poles (+) of the magnets 72 facing each other, and the magnet assembly 52 is depicted with the negative (−) pole of the magnet 78 facing radially inward and the positive poles (+) of the magnets 76, 80 facing radially inward, it will be appreciated that these pole positions could easily be reversed in keeping with the principles of the invention. Furthermore, other numbers and arrangements of the magnets 72, 76, 78 and 80 may be used, and the magnet assemblies 52, 54 may be otherwise configured without departing from the principles of the invention.

There could be multiple magnet assemblies 54 circumferentially distributed about the member 56, so that at least one of the magnet assemblies 54 would be closely radially aligned with the magnet assembly 52. In this manner, it would not be necessary to radially align the closure assembly member 56 relative to the housing member 58. In the FIG. 2 embodiment, the member 56 can rotate relative to the magnet assembly 54, and the magnet assembly is separately aligned with the magnet assembly 52 (as described more fully below), so that it is not necessary to radially align the members 56, 58 with each other. However, the members 56, 58 could be radially aligned, if desired.

Figure 4:
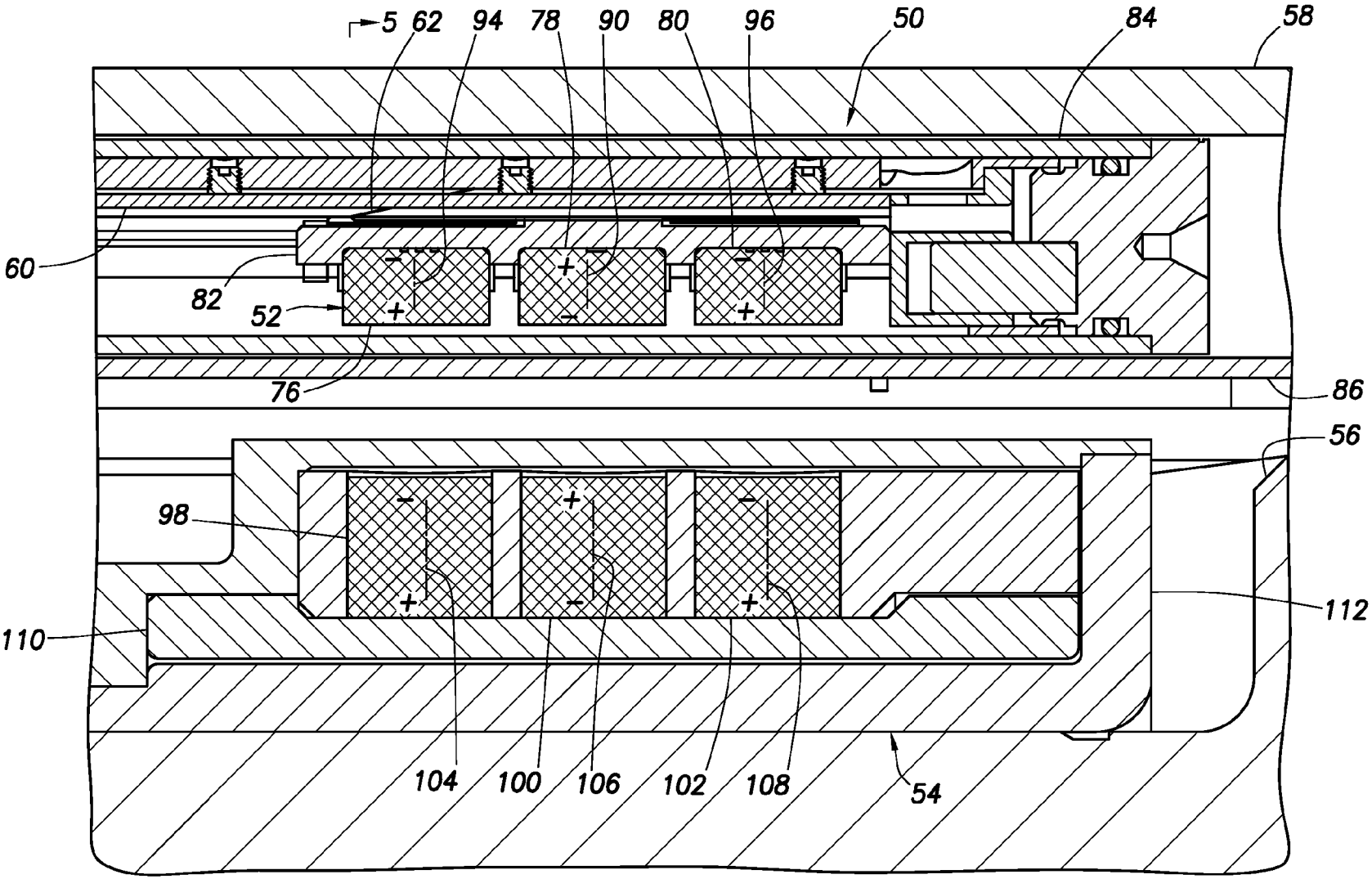
FIG. 4 is a cross-sectional view of a first alternative configuration of the position sensor.

Referring additionally now to FIG. 4, an alternate configuration of the position sensor 50 is representatively illustrated. Elements of this configuration which are similar to those described above are indicated in FIG. 4 using the same reference numbers.

In the alternate configuration depicted in FIG. 4, the magnet assembly 52 is similar to that shown in FIG. 2, but the inner magnet assembly 54 attached to the closure assembly member 56 is differently configured. Instead of the two magnets 72, the magnet assembly 54 includes three magnets 98, 100, 102 having pole axes 104, 106, 108 which are aligned and collinear with the respective pole axes 94, 90, 96 of the magnet assembly 52.

Another difference is that, instead of the magnetically permeable material 92 positioned at opposite ends of the magnets 72 as in FIG. 2, the magnet assembly 54 as depicted in FIG. 4 includes a magnetically permeable material 110 opposite the magnets 98, 100, 102 from the magnet assembly 52. In this manner, the magnetic reluctance between the poles of the magnets 98, 100, 102 is reduced, thereby increasing the magnetic coupling force between the magnet assemblies 52, 54.

Figure 5:
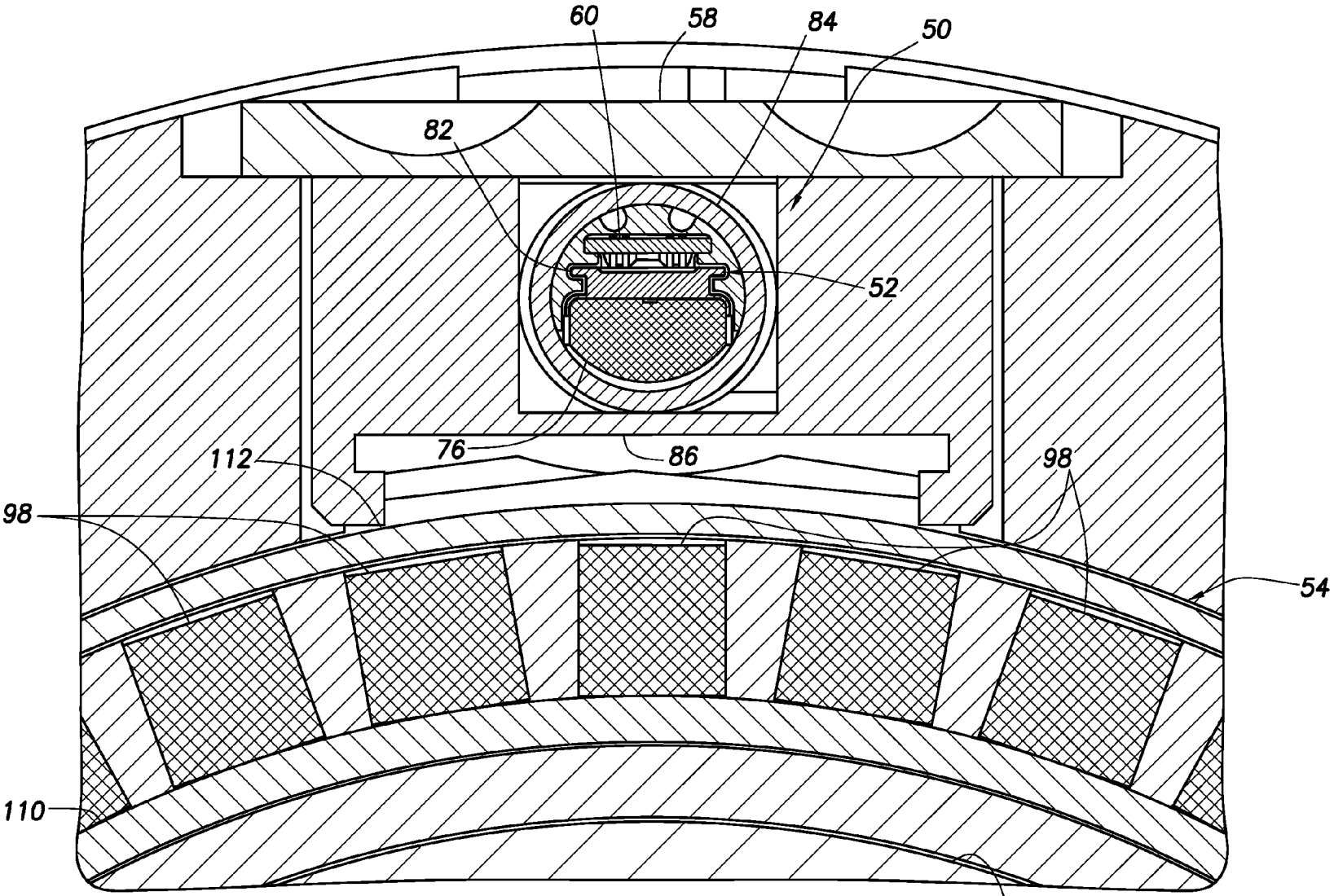
FIG. 5 is a cross-sectional view of the first alternative configuration, taken along line 5-5 of FIG. 4.

Yet another difference is that, as illustrated in FIG. 5, there are multiple sets of the magnets 98, 100, 102 circumferentially distributed about the member 56. A housing 112 also extends circumferentially about the member 56 and isolates the magnets 98, 100, 102 from well fluid and debris in the well tool 16. As mentioned above, this arrangement dispenses with a need to radially orient the members 56, 58, although such radial orientation could be provided, if desired. Note that the FIG. 2 embodiment could include multiple magnet assemblies 54 circumferentially distributed about the member 56 in a manner similar to that depicted in FIG. 5 for the magnets 98, 100, 102 circumferentially distributed about the member 56, as discussed above.

Figure 6:
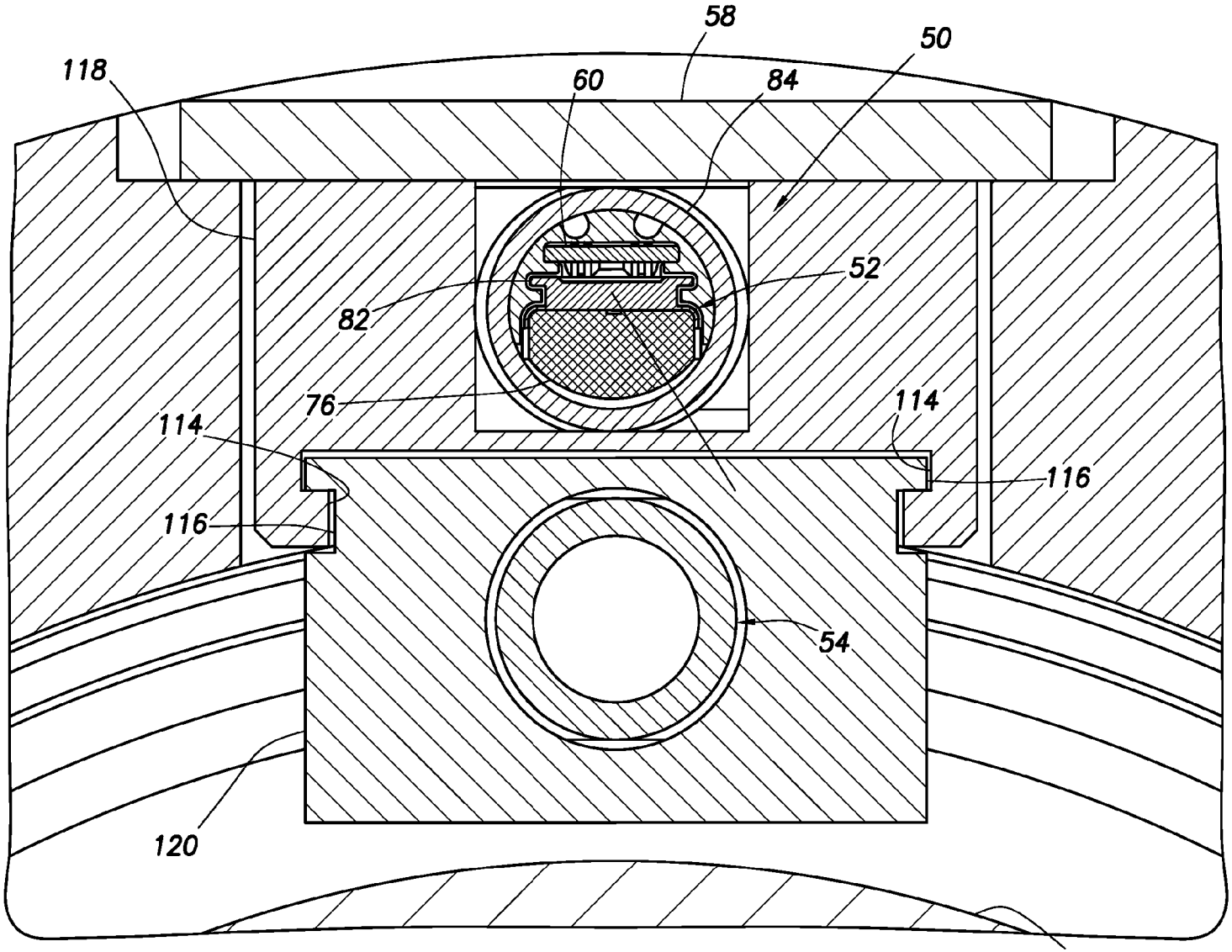
FIGS. 6 & 7 are cross-sectional views of respective second and third alternative configurations of the position sensor.

Referring additionally now to FIG. 6, another alternate configuration of the position sensor 50 is representatively illustrated. Elements of this configuration which are similar to those described above are indicated in FIG. 6 using the same reference numbers.

In the alternate configuration depicted in FIG. 6, the inner magnet assembly 54 is maintained in radial alignment with the magnet assembly 52 by means of interlocking tongues 114 and grooves 116 formed on a housing 118 containing the tubular structure 84 and a housing 120 containing the magnet assembly 54. This configuration may be used for the position sensor 50 as depicted in FIG. 2.

In this case, the housing 120 is a pressure bearing housing, and is made of a non-magnetically permeable material (such as inconel, etc.). Thus, the housing 120 isolates the magnet assembly 54 from well pressure, well fluid and debris.

Figure 7:
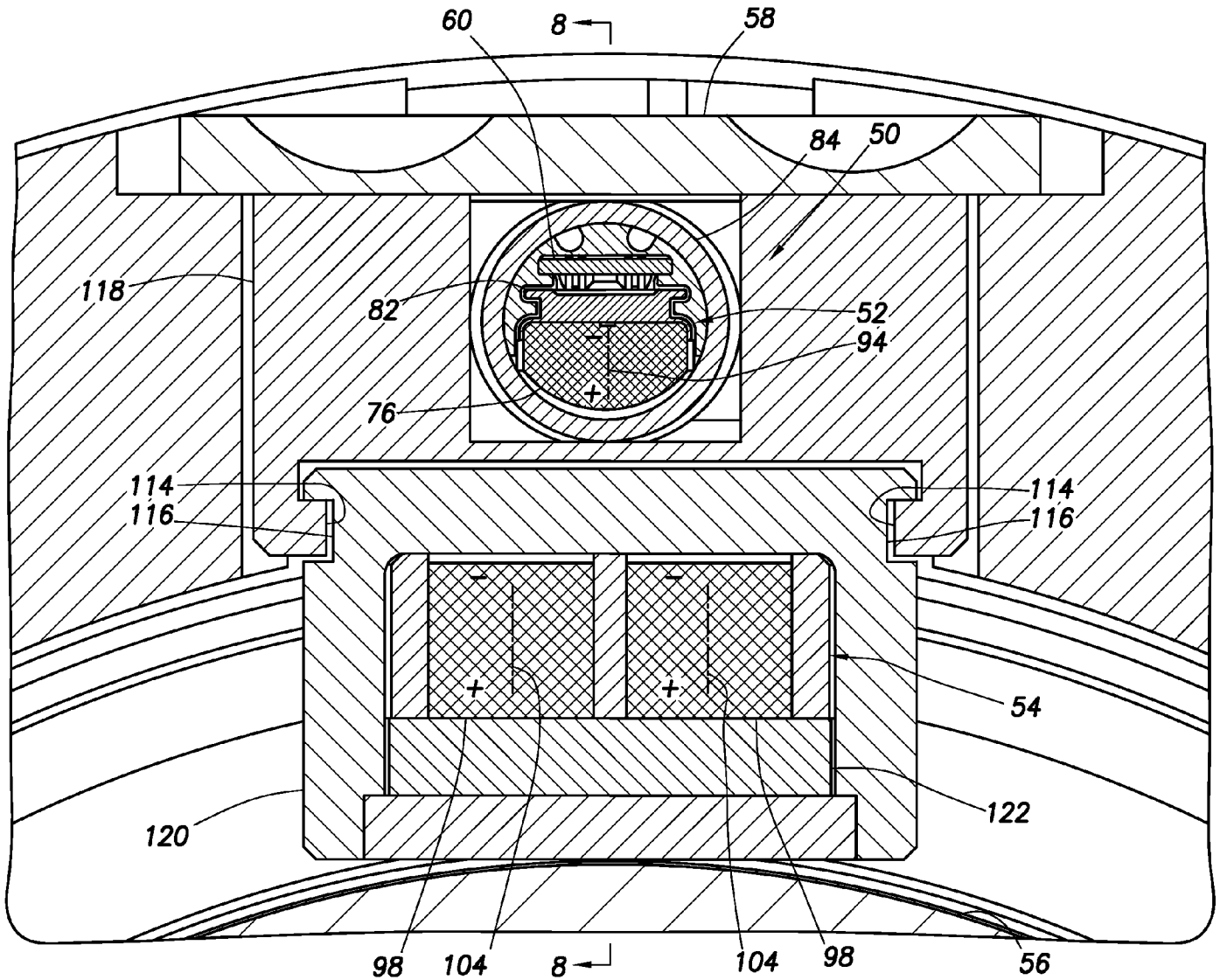

Referring additionally now to FIG. 7, another alternate configuration of the position sensor 50 is representatively illustrated. Elements of this configuration which are similar to those described above are indicated in FIG. 7 using the same reference numbers.

In the alternate configuration depicted in FIG. 7, the magnet assembly 54 includes two rows of the three magnets 98, 100, 102 illustrated in FIG. 4. In this configuration, the rows of magnets 98, 100, 102 straddle the pole axes 94, 90, 96 of the respective magnets 76, 78, 80 of the magnet assembly 52. Thus, the pole axes 94, 90, 96 are parallel to the pole axes 104, 106, 108 of the magnets 98, 100, 102, but are not collinear.

Figure 8:
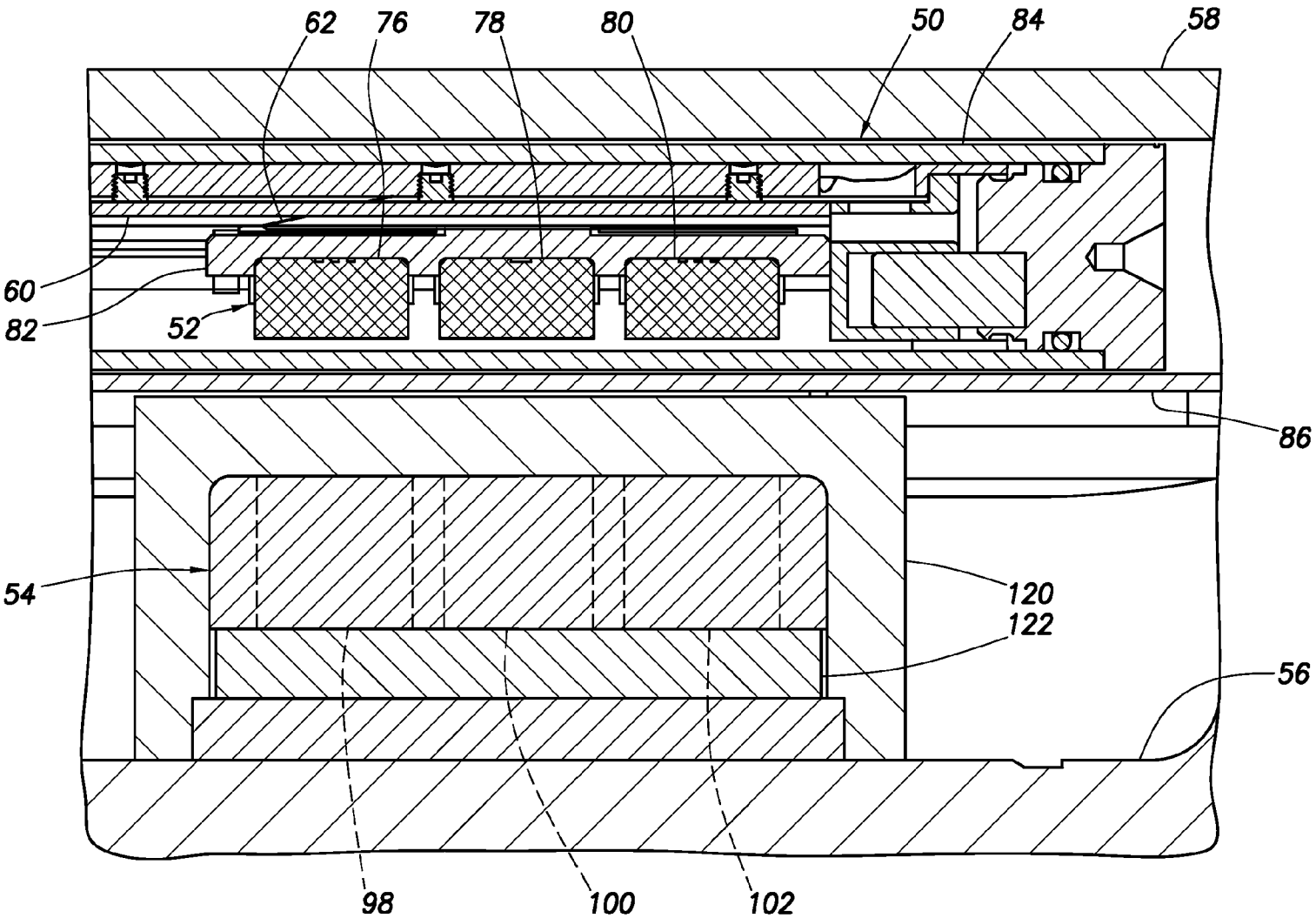
FIG. 8 is a cross-sectional view of the third alternative configuration of the position sensor, taken along line 8-8 of FIG. 7.

Similar to the magnetically permeable material 110 of the alternate configuration depicted in FIG. 4, the alternate configuration depicted in FIG. 7 includes a magnetically permeable material 122 positioned radially inwardly adjacent the magnets 98, 100, 102. Another cross-sectional view of the position sensor 50 is illustrated in FIG. 8.

One advantage of the invention as described herein is that it permits greater separation between the magnet assemblies 52, 54, while still maintaining adequate magnetic coupling force, so that the magnetic assembly 52 displaces with the magnetic assembly 54. In an alternate configuration of the position sensor 50 representatively illustrated in FIG. 9, the separation between the magnetic assemblies 52, 54 is large enough that a wall 124 between the magnetic assemblies can serve as a pressure isolation barrier between the interior and exterior of the well tool 16. This is just one manner in which the increased magnetic coupling force between the magnetic assemblies 52, 54 provides greater flexibility in designing well tools for downhole use.

Figure 9:
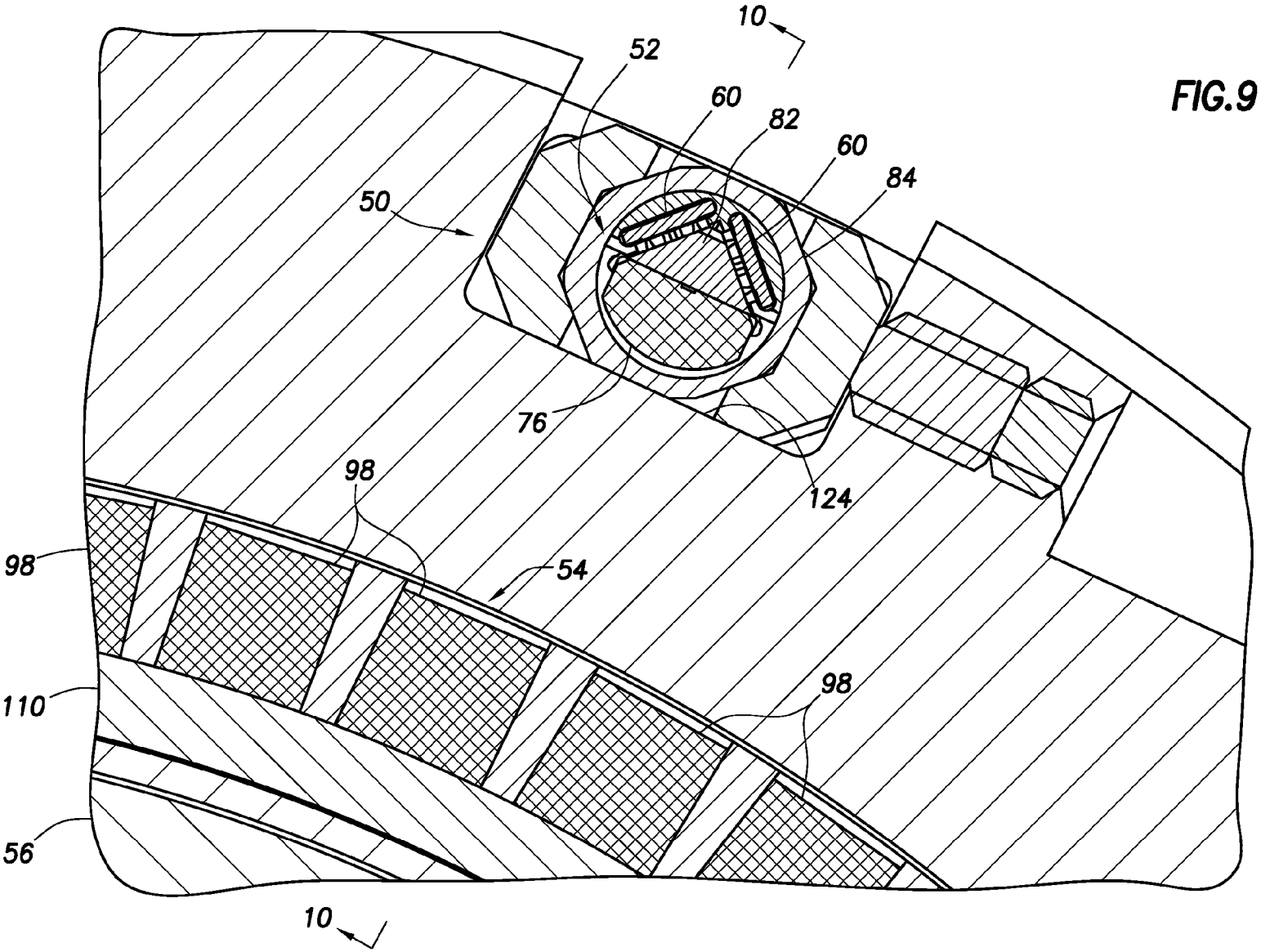
FIG. 9 is a cross-sectional view of a fourth alternative configuration of the position sensor installed in an alternative configuration well tool.

Another difference between the configuration depicted in FIG. 9 and the previously described configurations, is that the magnetic assembly 54 is positioned in a chamber which is isolated from well fluid and debris in the well tool 16. Thus, there is no need for a separate pressure bearing housing about the magnets 98, 100, 102.

Yet another difference in the configuration depicted in FIG. 9 is that two resistive elements 60 are used in the tubular structure 84. This provides increased resolution in determining the position of the slider 82 and/or provides for redundancy in the event that one of the resistive elements 60, contacts 62, or other associated elements should fail in use. In addition, this configuration provides for a greater volume of the magnetically permeable slider 82 material, thereby further increasing the magnetic flux density between the magnet assemblies 52, 54.

Figure 10:
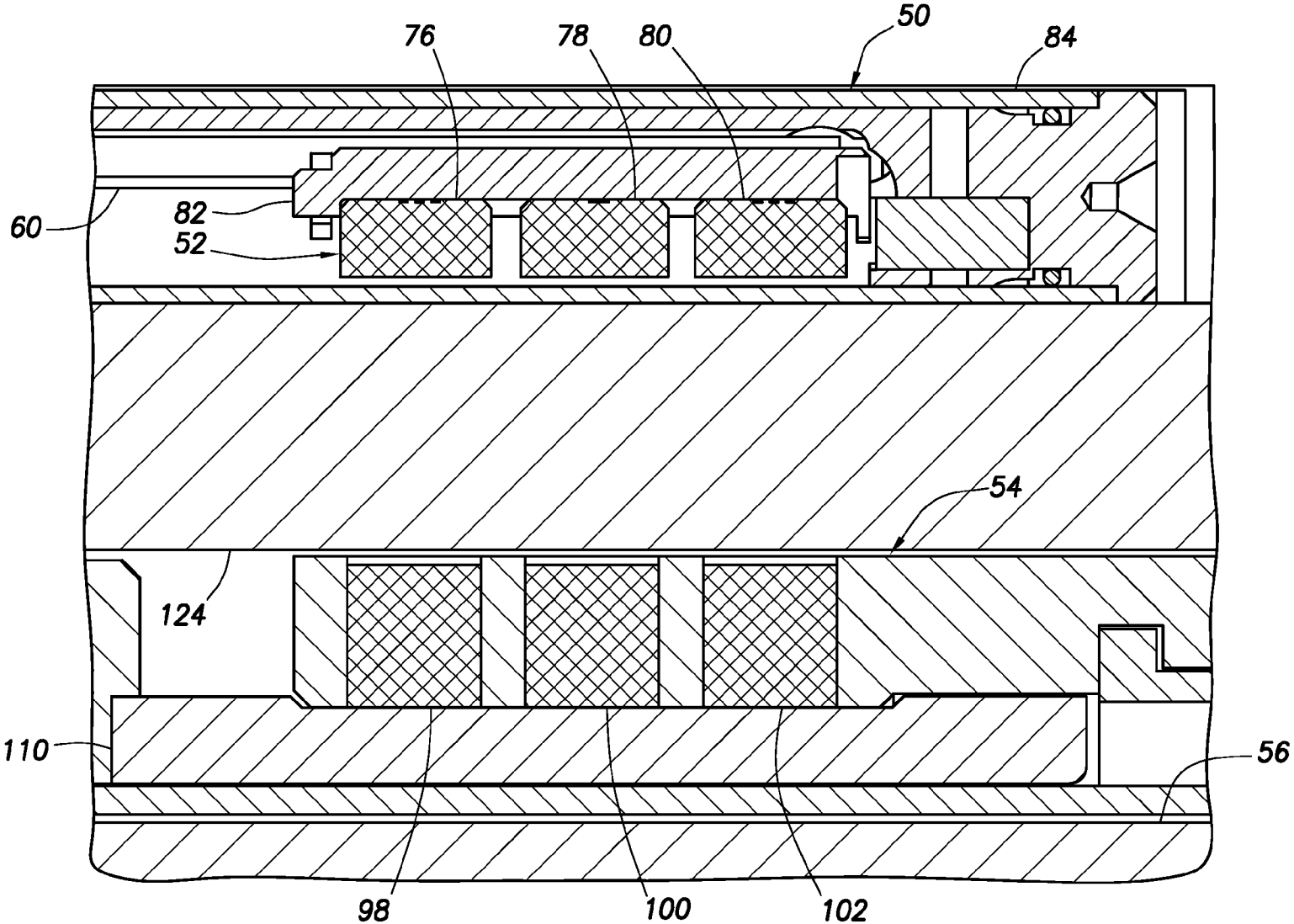
FIG. 10 is a cross-sectional view of the fourth alternative configuration of the position sensor, taken along line 10-10 of FIG. 9.

Another cross-sectional view of the configuration of FIG. 9 is depicted in FIG. 10. In this view the relative positionings of the magnets 76, 78, 80, 98, 100, 102 and the magnetically permeable slider 82 and material 110 on opposite sides of the wall 124 may be clearly seen. The magnetically permeable slider 82 and material 110 serve to decrease the magnetic reluctance between the respective magnets 76, 78, 80 and magnets 98, 100, 102 to thereby increase the magnetic coupling force between the magnetic assemblies 52, 54.

Note that in the embodiments depicted in FIGS. 4-10, the magnet assembly 54 could include the magnets 72 having their pole axes 88 perpendicular to the pole axes 90, 94, 96 of the magnets 76, 78, 80, instead of including the magnets 98, 100, 102 with their pole axes 104, 106, 108 parallel to or collinear with the pole axes 90, 94, 96, if desired. Furthermore, any of the embodiments described herein could include features of any of the other embodiments, in keeping with the principles of the invention.

Figure 11:
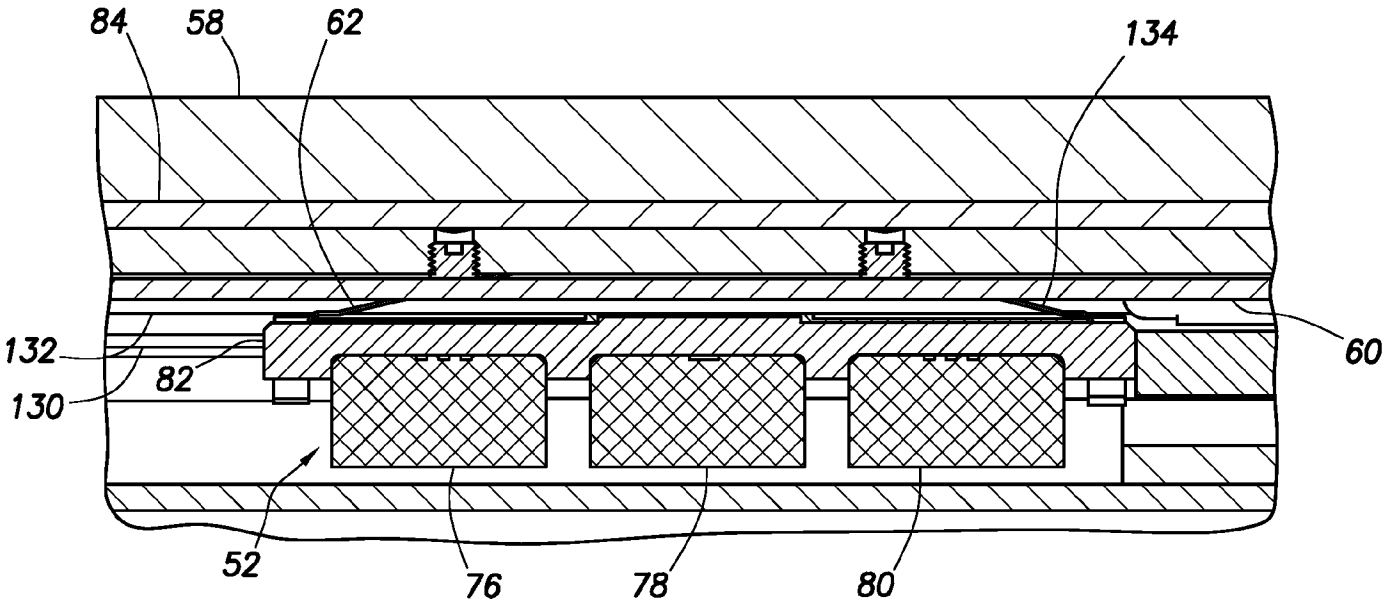
FIG. 11 is an enlarged scale cross-sectional view of the configuration of FIG. 2, with an alternative contacts arrangement.

Referring additionally now to FIG. 11, an enlarged scale cross-sectional view of an alternate configuration of the FIG. 2 embodiment is representatively illustrated. In this enlarged view, it may be seen that the slider 82 traverses along a set of rails 130 and grooves 132 in the tubular structure 84. The manner in which the slider 82 is supported for sliding displacement in the tubular structure 84 can also be seen in FIGS. 5-7 from another perspective.

In order to minimize binding of the slider 82 as it traverses the rails 130 and grooves 132, it is desirable to equalize the forces applied at each end of the slider. It will be appreciated that the set of contacts 62 at one end of the slider 82 applies a certain force to the slider due to their resilient contact with the resistive element 60 and the drag produced as the contacts slide across the resistive element.

In the configuration depicted in FIG. 11, another set of contacts 134 is positioned at an opposite end of the slider 82. This additional set of contacts 134 results in an equal force being applied to the opposite end of the slider 82, thereby equalizing or balancing the forces applied by the sets of contacts 62, 134 and reducing any binding which might occur between the slider as it displaces along the rails 130 and grooves 132.

Note that the contacts 134 may be used solely for balancing the forces applied to the slider 82, or the contacts may also be used for electrically contacting the resistive element 60. For example, the contacts 134 may provide an additional conductive path between the resistive traces 68 and pads 70 (i.e., in addition to the conductive path provided by the contacts 62), the contacts 134 may be part of a single conductive path which also includes the contacts 62 (e.g., one or more fingers of the contacts 62 may electrically contact only one of the resistive traces 68, and one or more fingers of the contacts 134 may electrically contact the other one of the resistive traces 68, with the electrically contacting fingers of the contacts 62, 134 being electrically connected to each other), or the contacts 134 may not electrically contact the resistive element 60 for providing a conductive path between the resistive traces 68 at all, etc.

It may now be fully appreciated that the present invention provides a well tool 16 which includes members 56, 58, with relative displacement between the members being produced in operation of the well tool, and a magnetically coupled position sensor 50 including magnet assemblies 52, 54. One magnet assembly 54 is attached to the member 56 for displacement with that member, and the other magnet assembly 52 is movably attached to the other member 58 and magnetically coupled to the first magnet assembly 54 for displacement therewith. The position sensor 50 further including a magnetically permeable material 82, 92, 110, 122 which increases a magnetic flux density between the magnet assemblies 52, 54.

The magnet assembly 54 may include at least one magnet 98 having a pole axis 104, and the other magnet assembly 52 may include at least another magnet 76 having another pole axis 94, with the pole axes being aligned with each other. The pole axes 94, 104 may be collinear. The magnet assembly 54 could alternatively include the magnet 98 with the pole axes 104 being parallel to the pole axis 94, or at least one magnet 72 with pole axis 88 perpendicular to the pole axis 94.

The member 56 may be a portion of a closure assembly 40 of the well tool 16.

The magnetically permeable material 92, 110, 122 may be positioned adjacent the magnet assembly 54 for displacement with the magnet assembly.

The magnet assembly 54 may be positioned radially inward relative to the magnet assembly 52, and the magnetically permeable material 92 may longitudinally straddle magnets 72 in the magnet assembly.

The magnet assembly 54 may include multiple magnets 98, 100, 102 or magnets 72 which are circumferentially spaced apart about the member 56. The magnetically permeable material 110 may be positioned between the magnets 98, 100, 102 and the member 56.

The magnet assembly 54 may include at least a magnet 72, the other magnet assembly 52 may include at least another magnet 78, and the magnet 78 may be positioned between the magnetically permeable material 82 and the first magnet 72.

The magnet assembly 54 may include a housing 120 containing at least one magnet 98, the other magnet assembly 52 may include another housing 118 containing at least a second magnet 76. The housings 118, 120 may be slidably engaged, thereby permitting relative displacement between the housings but maintaining radial alignment of the magnet assemblies 52, 54.

The magnet assembly 54 may include a housing 74, 112, 120 containing at least one magnet 72, 98. The housing 74, 112, 120 may isolate the magnet 72, 98 from fluid in the well tool 16.

The magnet assembly 52 may include a housing 84 containing at least one magnet 76, 78, 80. The housing 84 may isolate the magnet 76, 78, 80 from fluid in the well.

The magnet assembly 52 may include a slider 82 having opposite ends. A first contact 62 may be positioned at one opposite end, and a second contact 134 may be positioned at the other opposite end for balancing forces applied to the slider 82. Either or both of the contacts 62, 134 may be used for providing one or more conductive paths between the resistive traces 68 on the resistive element 60.

Figure 12:
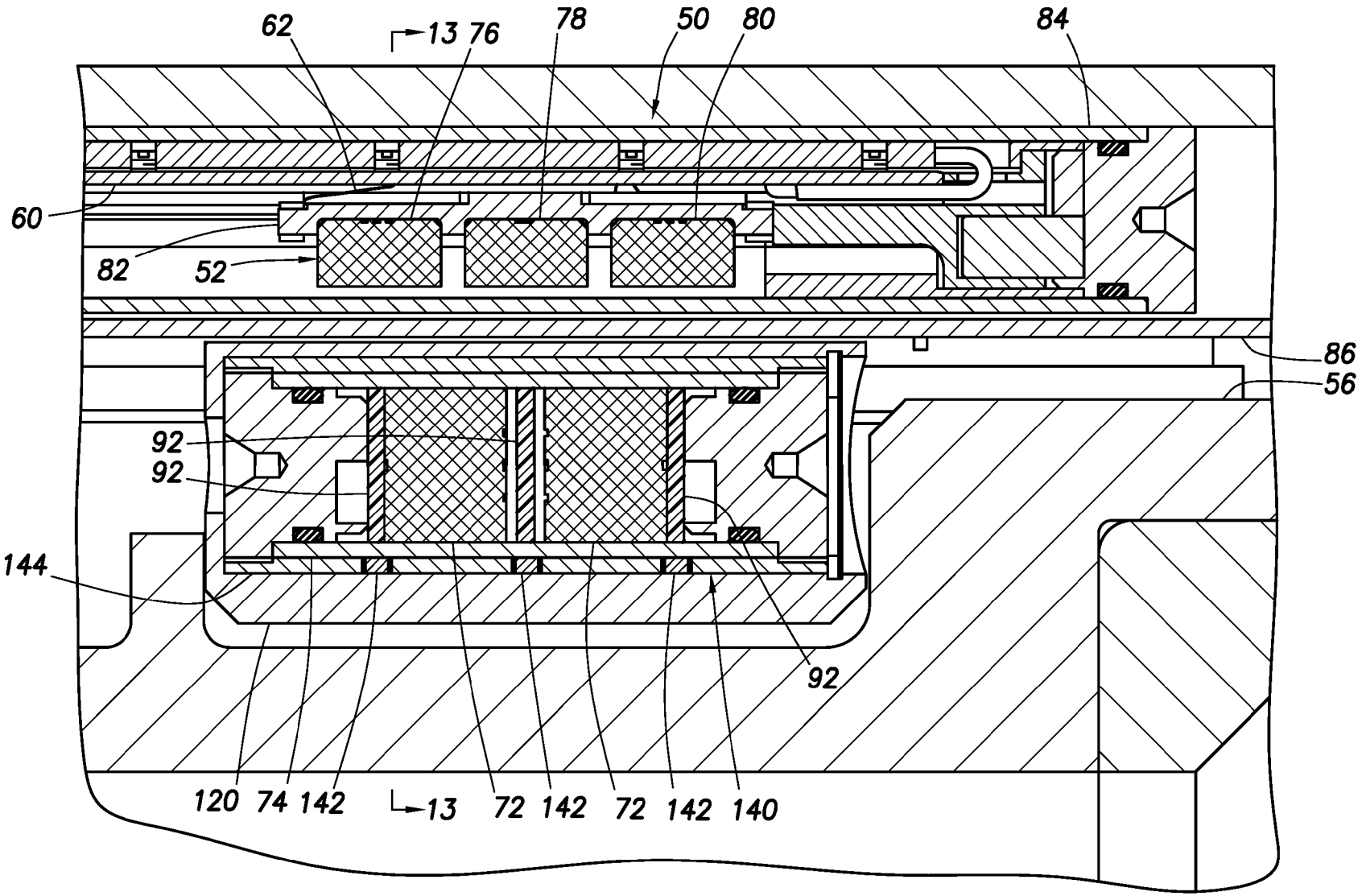
FIG. 12 is a cross-sectional view of a fifth alternative configuration of the position sensor.

Referring additionally now to FIG. 12, another alternative configuration of the position sensor 50 is representatively illustrated. This configuration is similar in many respects to the configuration depicted in FIG. 2, and so the same reference numbers have been used in FIG. 12 to indicate similar elements.

One significant difference in the FIG. 12 configuration is that an additional one of the magnetically permeable material 92 is positioned between the magnets 72 in a magnet assembly 140. The magnet assembly 140 essentially takes the place of the magnet assembly 54 depicted in FIG. 2.

The magnetically permeable material 92 between the magnets 72 is illustrated as being of similar shape and size to the magnetically permeable material positioned at the opposite ends of the magnets, but the sizes and shapes of these elements may vary if desired. It will be appreciated by those skilled in the art that the magnetically permeable material 92 between the magnets 72 produces a high magnetic flux density between the magnets oriented perpendicular to the pole axes 88 of the magnets.

To take advantage of this high magnetic flux density between the magnets 72, the magnet 78 of the magnet assembly 52 is positioned with its opposite pole facing toward the high magnetic flux density between the magnets 72, and with its pole axis 90 perpendicular to the pole axes 88 of the magnets 72. This serves to further increase the magnetic coupling force between the magnets 72 and the magnet 78.

This increased coupling force allows the air gap between the magnets 72 to be reduced, even though their pole axes 88 are aligned the same as in the FIG. 2 configuration. The increased coupling force causes the magnet assembly 52 to displace more precisely with the magnet assembly 140 (e.g., reduces hysteresis) for a given separation between the magnet assemblies, or allows for greater separation between the magnet assemblies for a given coupling force.

Figure 13:
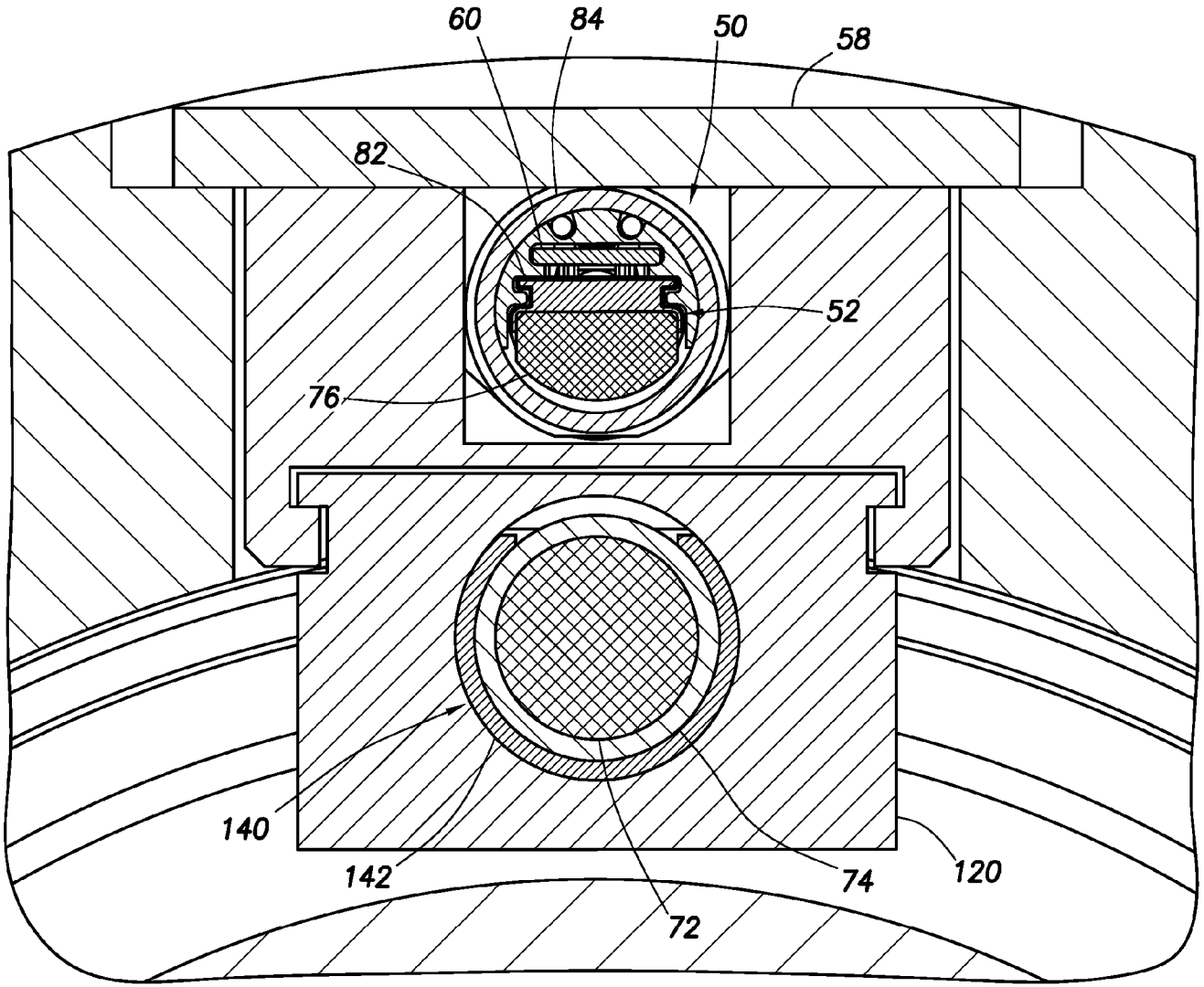
FIG. 13 is a cross-sectional view of the fifth alternative configuration, taken along line 13-13 of FIG. 12.

Another significant difference of the configuration depicted in FIG. 12 is the use of additional magnetically permeable rings 142 aligned with respective ones of the magnetically permeable material 92, but external to the housing 74. As depicted in FIGS. 12 & 13, these rings 142 are split (i.e., not fully circumferential) and are held in position by a spacer sleeve 144 installed between the housings 74, 120. The spacer sleeve 144 is preferably made of a non-magnetically permeable material.

The magnetically permeable rings 142 function to increase the perpendicular orientation of the magnetic flux relative to the pole axes 88 of the magnets 72, and thereby increase the magnetic flux density between the magnet assemblies 52, 140. Note that the rings 142 are not positioned directly between or directly opposite the ends of the magnets 72. Instead, the rings 142 are positioned somewhat radially outward from the magnets 72, so that they will operate to focus the magnetic flux in its perpendicular orientation relative to the pole axes 88 at a distance removed from the magnets.

The increased magnetic flux density between the magnet assemblies 52, 140 provided by the rings 142 increases the coupling force therebetween, thereby providing the benefits of increased coupling force described above. Another benefit is that magnetically permeable material in the well tool 16 (such as any chromium-containing elements in the housing assembly or closure assembly) can be positioned in closer proximity to the magnet assemblies 52, 140 without eliminating the ability of the magnet assembly 52 to track displacement of the magnet assembly 140. This benefit will be especially important in situations where space is limited in the well tool 16.

Although the rings 142 are depicted as being positioned between the housings 74, 120, it should be clearly understood that other locations are possible in keeping with the principles of the invention. For example, the rings 142 could be positioned inside the housing 74, or could form a part of the housing.

The rings 142, or similar magnetically permeable material, could also be positioned adjacent the magnets 76, 78, 80, as well. For example, magnetically permeable material elements could be positioned between each of the magnets 76, 78, 80 and the tubular structure 84. The magnetically permeable material elements could be carried by the slider 82, attached directly to the magnets 76, 78, 80 or otherwise secured in the magnet assembly 52.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well tool for use in conjunction with a subterranean well, the well tool comprising:

first and second members, relative displacement between the first and second members being produced in operation of the well tool; and a magnetically coupled position sensor including first and second magnet assemblies, the first magnet assembly being attached to the first member for displacement with the first member, the second magnet assembly being movably attached to the second member and coupled by a magnetic coupling force to the first magnet assembly for displacement with the first magnet assembly, and the position sensor further including a first magnetically permeable material which increases a magnetic flux density between the first and second magnet assemblies, the first magnetically permeable material being positioned between first and second magnets of the first magnet assembly.

2. The well tool of claim 1, wherein the first magnet has a first pole axis, the second magnet has a second pole axis, and wherein the first and second pole axes are aligned with each other.

3. The well tool of claim 1, wherein the first member is a portion of a closure assembly of the well tool.

4. The well tool of claim 1, wherein the first magnetically permeable material is also positioned at opposite ends of the first and second magnets.

5. The well tool of claim 1, wherein the first magnet assembly includes a housing containing the first and second magnets, the housing isolating the first and second magnets from fluid in the well, and wherein a second magnetically permeable material is positioned external to the housing and aligned with the first magnetically permeable material.

6. A well tool for use in conjunction with a subterranean well, the well tool comprising:

first and second members, relative displacement between the first and second members being produced in operation of the well tool; and a magnetically coupled position sensor including first and second magnet assemblies, the first magnet assembly being attached to the first member for displacement with the first member, the second magnet assembly being movably attached to the second member and coupled by a magnetic coupling force to the first magnet assembly for displacement with the first magnet assembly, the first magnet assembly including at least a first magnet having a first pole axis, the second magnet assembly including at least a second magnet having a second pole axis, the first and second pole axes being aligned with each other, and wherein a first magnetically permeable material is positioned between the first and second magnets and straddling the first and second magnets.

7. The well tool of claim 6, wherein the first magnetically permeable material increases a magnetic flux density between the first and second magnet assemblies.

8. The well tool of claim 6, wherein the first and second pole axes are collinear.

9. The well tool of claim 6, wherein the first and second pole axes are parallel to each other.

10. The well tool of claim 6, wherein the first member is a portion of a closure assembly of the well tool.

11. The well tool of claim 6, wherein the first magnet assembly includes a housing containing the first and second magnets, the housing isolating the first and second magnets from fluid in the well.

12. The well tool of claim 6, further comprising a second magnetically permeable material spaced apart from the first and second magnets and aligned with the first magnetically permeable material.

13. A well tool for use in conjunction with a subterranean well, the well tool comprising:

first and second members, relative displacement between the first and second members being produced in operation of the well tool; and a magnetically coupled position sensor including first and second magnet assemblies, the first magnet assembly being attached to the first member for displacement with the first member, the second magnet assembly being movably attached to the second member and coupled by a magnetic coupling force to the first magnet assembly for displacement with the first magnet assembly, and the position sensor further including a first magnetically permeable material which increases a magnetic flux density between the first and second magnet assemblies, the first magnetically permeable material being positioned adjacent first and second magnets of the first magnet assembly, and a second magnetically permeable material being spaced apart from the first and second magnets and aligned with the first magnetically permeable material.

14. The well tool of claim 13, wherein the first magnetically permeable material is positioned between the first and second magnets.

15. The well tool of claim 13, wherein the first magnetically permeable material is positioned straddling the first and second magnets.

16. The well tool of claim 13, wherein the first magnet assembly includes a housing containing the first and second magnets, the housing isolating the first and second magnets from fluid in the well.

17. The well tool of claim 16, wherein the second magnetically permeable material is positioned external to the housing.

18. The well tool of claim 13, wherein first and second pole axes of the respective first and second magnets are collinear.

19. The well tool of claim 13, wherein first and second pole axes of the respective first and second magnets are parallel to each other.

20. The well tool of claim 13, wherein the first member is a portion of a closure assembly of the well tool.

* * * * *